US005203183A

United States Patent [19]

Salerno

[11] Patent Number: 5,203,183

[45] Date of Patent: Apr. 20, 1993

[54] ROTATABLE EARRING AND METHOD FOR MAKING THE SAME

[76] Inventor: Robert U. Salerno, 21-69 W. 9th St., Brooklyn, N.Y. 11223

[21] Appl. No.: 822,058

[22] Filed: Jan. 16, 1992

[51] Int. Cl.[5] ..... A44C 7/00

[52] U.S. Cl. ..... 63/12

[58] Field of Search ..... 63/12, 13, 14.1, 20, 63/31

[56] References Cited

U.S. PATENT DOCUMENTS

| | | | |
|---|---|---|---|
| 922,212 | 5/1909 | Tropin | 63/31 |
| 2,931,196 | 4/1960 | Liftman | 63/31 |
| 3,968,661 | 7/1976 | Williams | 63/20 |
| 4,052,864 | 10/1977 | Hofsaess | 63/31 |
| 4,056,951 | 11/1977 | Black | 63/13 |
| 4,057,980 | 11/1977 | DeCesaris | 63/13 |
| 4,077,237 | 3/1978 | Loper | 63/31 |
| 4,195,492 | 4/1980 | Johnson | 63/12 |
| 4,682,477 | 7/1987 | Vaillancourt | 63/12 |
| 4,841,746 | 6/1989 | Chen | 63/31 |

*Primary Examiner*—Renee S. Luebke
*Assistant Examiner*—Michael J. Milano
*Attorney, Agent, or Firm*—Abdallah & Muckelroy

[57] ABSTRACT

An earring of unitary construction having a rotatable element and a method of making the same. The earring includes a first ornamental portion which freely rotates about a ball bearing assembly fixedly attached to the first ornamental portion, a second ornamental portion disposed to the front of the first ornamental portion which remains fixed, and a bearing cap assembly disposed to the rear of the first ornamental portion which is fixedly attached to the second ornamental portion and includes a bearing cap which covers the ball bearing assembly, and an ear clasp for selective attachment of the earring to a wearer's ear.

11 Claims, 2 Drawing Sheets

ROTATABLE EARRING AND METHOD FOR MAKING THE SAME

BACKGROUND OF THE INVENTION

The present invention generally relates to jewelry. More particularly this invention relates to a metal earring that includes a rotatable element and a method of making the same.

Various jewelry items having rotatable elements are known in the prior art. These jewelry items are generally limited to finger rings, bracelets and pendants. The rotatable elements of prior art jewelry items generally rotate within the plane of the support for the rotatable portions of the jewelry as opposed to rotating laterally relative to the support.

Metal earrings having rotatable elements present special problems because of their close disposition to sensitive areas of the wearer's skin. While it is desirous to retain an earring having rotatable elements in close proximity to the wearer's ear, metal rotating elements can irritate the wearer's ear if permitted to rub the sensitive skin of the ear lobe. Perspiration and skin oils can also damage a rotation mechanism. Thus, important features for a metal earring having rotatable elements include means to prevent the rotating elements from striking the wearer's ear and means to protect the rotation mechanism from dirt, hair and skin oils, perspiration and the like.

Prior art jewelry items having rotatable elements are also generally constructed of separate elements which are threadedly or otherwise selectively attached to each other to form the completed jewelry item. No unitary construction for a jewelry item having rotatable elements is known to the Applicant to be disclosed in the prior art.

U.S. Pat. No. 4,052,864 to Hofsaess discloses a rotatable jewelry mounting that rotates laterally in an oscillating manner by means of an unbalanced magnetic assembly. In U.S. Pat. No. 4,841,746 to Chen a finger ring is shown having a plurality of ringlets rotatably mounted about a removable axle. These references illustrate the extent of prior art jewelry known to the Applicant having laterally rotatable elements.

SUMMARY OF THE INVENTION

The present invention is an earring of unitary construction having a laterally rotatable element, and a method for making the same. The earring includes a first ornamental portion that freely rotates about a bearing axle of a bearing cap assembly. A second ornamental portion of the earring is fixedly attached to an end of the bearing axle at the forward side of the first ornamental portion. The bearing cap assembly also includes a bearing cap fixedly attached to the opposite end of the bearing axle from the first ornamental portion and disposed to the rearward side of the first ornamental portion. Ear clasping means for selective attachment of the earring to a wearer's ear is fixedly attached to the opposite side of the bearing cap from the bearing axle.

An object of the present invention is to provide an earring having a laterally rotatable element.

Another object of this invention is to provide a unitary construction for an earring having a laterally rotatable element.

A further object of this invention is to provide an earring having a rotatable element that includes means to prevent the rotating element thereof from rubbing sensitive areas of the wearer's skin.

A still further object of the present invention is to provide means to protect the rotation mechanism in an earring having a rotatable element from dirt, skin oils, perspiration and the like.

It is also an object of the present invention to provide an earring having a rotatable element including means to retain the earring in flush bearing engagement with the wearer's ear.

A still further object of the present invention is to provide a method of making a metal earring of unitary construction, in particular a gold earring, having a rotatable element.

These and other objects and advantages of the present invention will be apparent to those skilled in the art from the following description of preferred embodiments, claims and appended drawings.

DESCRIPTION OF PREFERRED EMBODIMENTS

Figure 1:
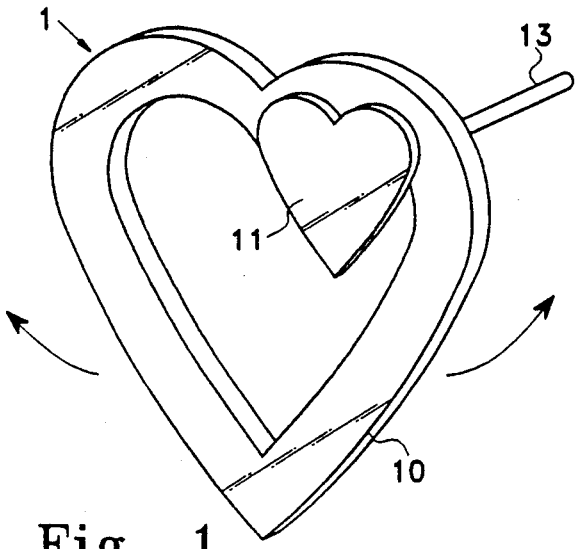
FIG. 1 is a front perspective view of a first embodiment of the earring of the present invention.
Figure 2:
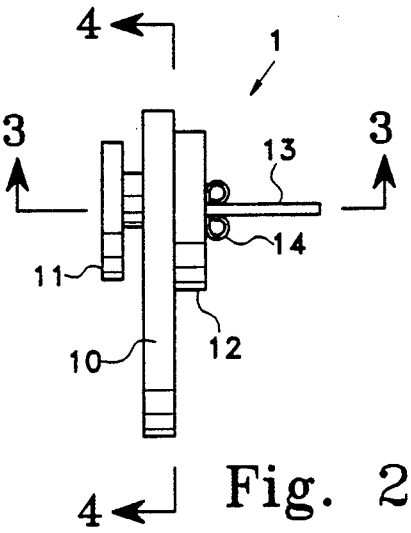
FIG. 2 is a side elevational view of the first earring.

FIG. 1 illustrates in a front perspective view a first preferred embodiment of earring 1 constructed in accordance with the teachings of the present invention. First earring 1 includes a first ornamental portion 10 which freely rotates laterally as shown by the arrows in FIG. 1. As best seen in the side elevational illustrated in FIG. 2, first earring 1 generally comprises the rotatable first ornamental portion 10, a second ornamental portion 11 disposed to the front of first ornamental portion 10, a bearing cap 12 disposed to the rear of first ornamental portion 10, an earlobe post 13 extending rearwardly from bearing cap 12, and an earlobe clasp 14 selectively receivable on earlobe post 13. First earring 1 is a pierced-ear type earring wherein earlobe post 13 is inserted into a hole in the wearer's earlobe, for example, and earlobe clasp 14 is thereafter attached to earlobe post 13 to retain the earring on the wearer's earlobe. In the first preferred embodiment of earring 1 of the present disclosure, first ornamental portion 10 and second ornamental portion 11 are respectively illustrated as heart-shaped members. However, the respective first and second ornamental portions 10, 11 may be formed in any of a variety of shapes without departing from this invention.

Figure 3:
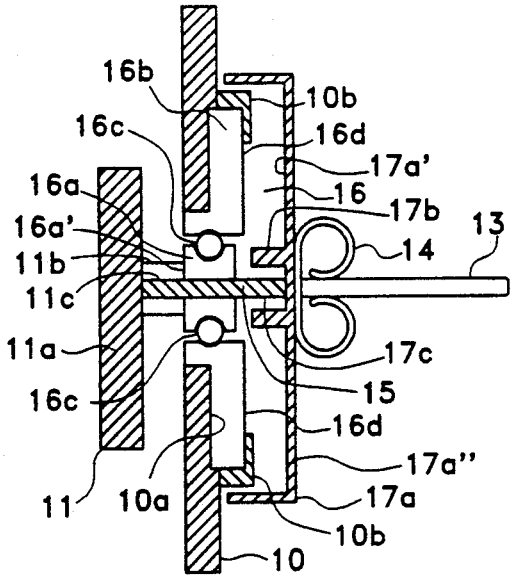
FIG. 3 is an enlarged cross-sectional view taken along line 3—3 of FIG. 2.

FIG. 3 illustrates a vertical cross-sectional view of first earring 1. Therein it can be seen that first ornamental portion 10 rotates about a bearing axle 15 via ball bearing rotation means 16. Ball bearing rotation means 16 comprises a central annular bearing retainer **16*a* having a central opening 16*a*' formed therein, an outer annular bearing retainer 16*b* and a plurality of ball bearings 16c disposed between the central bearing retainer 16a and the outer bearing retainer 16b. Central bearing retainer 16a and outer bearing retainer 16b freely rotate relative to each other via ball bearings 16c. A suitable ball bearing rotation means 16** is manufactured by Pioneer Bearing Corporation of West Orange, N.J.

Figure 4:
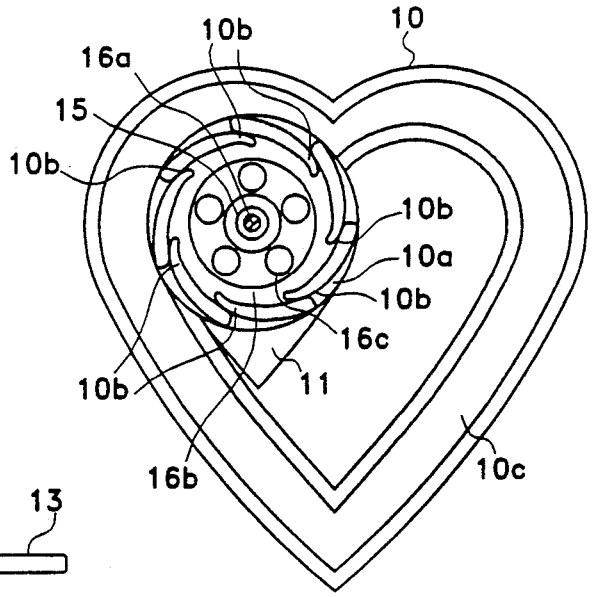
FIG. 4 is a rear elevational view of the first earring taken along line 4—4 of FIG. 2.

The outer retainer 16b of ball bearing rotation means 16 is formed having an annular shoulder 16d. Shoulder 16d is disposed in a recessed bearing seat 10a formed in the first ornamental portion 10. Ball bearing rotation means 16 is fixedly held in bearing seat 10a preferably by seat flanges 10b disposed to the rearward side of outer bearing retainer 16b. Thereby outer bearing retainer 16b is held in fixed engagement with first ornamental portion 10 whereby first ornamental portion 10 thusly freely rotates relative to central bearing retainer 16a. Seat flanges 10b may be formed as displaced extended portions of bearing seat 10a as shown in FIG. 3. Referring to FIG. 4 it can be seen that seat flanges 10b may also be formed as cut portions of the wall of bearing seat 10a which are bent over the outer bearing retainer 16b of ball bearing rotation means 16. In the alternative, shoulder 16d may be glued to bearing seat 10a for fixed attachment of ball bearing rotation means 16 to first ornamental portion 10. Further shown in FIG. 4 it can be seen that the rear wall 10c of first ornamental portion 10 is preferably recessed for material savings.

Second ornamental portion 11 is formed having a main body portion 11a and a raised bearing surface 11b extending from the rear wall of main body portion 11a. Bearing surface 11b has a central recess 11c which receives the forward end of bearing axle 15 in fixed engagement as hereinafter described in greater detail. The rearward end of bearing surface 11b engages the forward wall of the central bearing retainer 16a.

A bearing cap 17 is fixedly attached to the rearward end of bearing axle 15. Bearing cap 17 includes a cap main body portion 17a and a centrally disposed boss 17b integrally formed on the forward wall of cap main body portion 17a. Bearing axle 15 is preferably integrally formed with boss 17b and bearing cap main body portion 17a. Alternatively, boss 17b may be formed having a central boss recess 17c which receives the rearward end of axle 15 in fixed engagement. The forward end of boss 17b bears against the rearward wall of the central bearing retainer 16a of ball bearing rotation means 16. The forward wall 17a' of cap main body portion 17a is preferably recessed and cap main body portion 17a is formed having a sufficient diameter to completely cover ball bearing rotation means 16. The rearward wall 17a'' of cap main body portion 17a is preferably flat. Earlobe post 13 is fixedly attached to the rearward wall 17a'' of cap main body portion 17a.

Bearing cap 17 serves three important purposes to facilitate the utility of first earring 1. Firstly, bearing cap 17 protects ball bearing rotation means 16 from dirt, oil and perspiration which may prevent said rotation means 16 from operating properly. Secondly, bearing cap 17 maintains the rotatable first ornamental portion 10 and ball bearing rotation means 16 distant from the sensitive skin of the wearer's ear. Thirdly, the flat rearward wall 17a'' of cap main body portion 17a provides a bearing surface to help retain first earring 1 in close, flush relationship with the wearer's ear.

Figure 5:
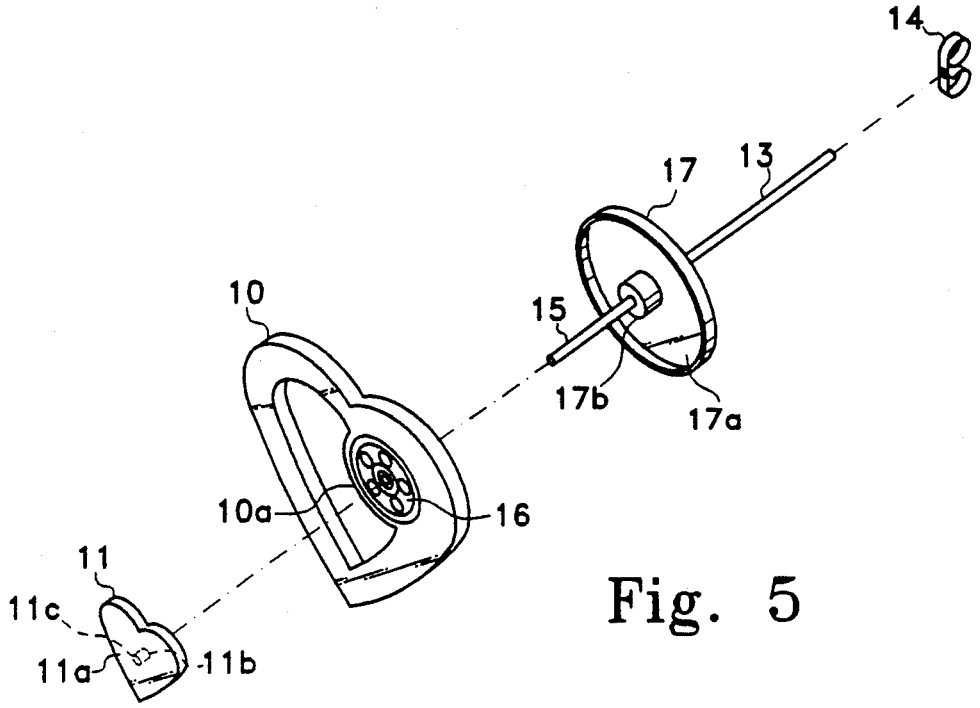
FIG. 5 is an exploded perspective view of components of first earring prior to assembly for a unitary construction.

The earring of the present invention is preferably formed from gold or other easily malleable metal material. To make a gold earring, for example, of unitary construction in accordance with the teachings of the present invention various components as illustrated in the exploded perspective view of FIG. 5 are formed and assembled as hereinafter described.

First ornamental portion 10 is die casted in the desired ornamental shape. Recessed bearing seat 10a may be either centrally or eccentrically disposed therein. Ball bearing rotation means 16 is then inserted into bearing seat 10a and the outer bearing retainer 16b thereof is fixedly attached to bearing seat 10a. The fixed attachment of outer bearing retainer 16b may be accomplished by gluing outer bearing retainer 16b to bearing seat 10a. Preferably the top of the wall of bearing seat 10 is cut and bent over outer bearing retainer 16b utilizing a hammer and chisel. Where bearing seat 10a is formed having seat flanges 10b comprising displaced extended portions of bearing seat 10a, the seat flanges 10b are simply hammered to extend over outer bearing retainer 16b for a tight fit of ball bearing rotation means 16 in bearing seat 10a.

Second ornamental portion 11 is then die casted in the desired ornamental shape with the central recess 11c of bearing surface 11b extending through the main body portion 11a to form a hole in main body portion 11a.

A bearing cap assembly comprising recessed cap main body portion 17a, centrally-disposed boss 17b and bearing axle 15 are preferably integrally die casted. Cap main body portion 17a is formed having a sufficient diameter to cover ball bearing rotation means 16. Bearing axle 15 is formed having a sufficient length to extend from boss 17b through first ornamental portion 10 and second ornamental portion 11. In the alternate, cap main body portion 17a and boss 17b may be integrally die casted with boss 17b having a boss recess 17c. Bearing axle 15 is then inserted into boss recess 17c and soldered for fixed attachment thereto. Earlobe post 13 is attached to the rearward wall 17a'' of cap main body portion 17a by soldering.

Figure 6:
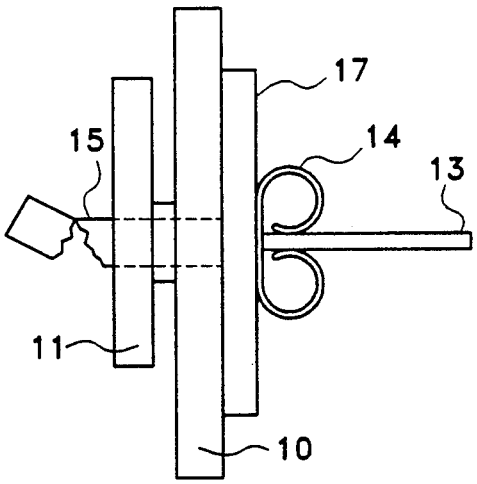
FIG. 6 is a side elevational view of the components illustrated in FIG. 5 shown assembled.

Bearing axle 15 is then inserted through the central opening 16a' of the ball bearing rotation means 16 of first ornamental portion 10 from rear to front and through the central recess 11c of second ornamental portion 11 from rear to front as illustrated in FIG. 6. Second ornamental portion 11 and bearing cap 17 are pressed tightly against first ornamental portion 10 to bring the bearing surface 11b of second ornamental portion 11 against the forward wall of the central bearing retainer 16a of ball bearing rotation means 16 and the boss 17b of bearing cap 17 against the rearward wall of the central bearing retainer 16a. The portion of axle 15 extending to the front of the main body portion 11a of second ornamental portion 11 through central recess 11c is then soldered to second ornamental portion 11 while holding the components pressed tightly together. The forwardly extending portion of axle 15 is then cut off (FIG. 6). The forward wall of the main body portion 11a of second ornamental portion 11 is then polished smooth. Earlobe clasp 14 is attached to earlobe post 14 for a finished first earring 1.

The resulting first earring 1 is a unitary construction which includes a rotatable first ornamental portion 10 that freely moves with actions of the wearer.

Figure 7:
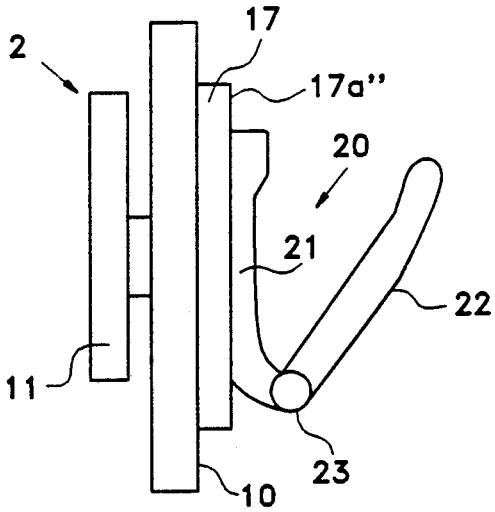
FIG. 7 is a side elevational view of a second embodiment of the earring of the present invention.

FIG. 7 illustrates in a side elevational view a second preferred embodiment of an earring 2 constructed in accordance with the teachings of the present invention. In lieu of post 13 and clasp 14 of the pierced-ear type first earring 1 illustrated in FIGS. 1–6, for a clip-on type earring 2, an ear clamp 20 comprising first and second clamp arms 21, 22 pivotally attached about a pivot spring 23 is shown. First clamp arm 21 is fixedly attached to the rearward wall 17*a*" of bearing cap 17. In all other respects second earring 2 is identical to first earring 1.

Various changes, additions and modifications to the preferred embodiments of the earring of the present invention may be made without departing from the spirit and scope of the present disclosure. Such changes, additions and modifications within a fair reading of the following claims are intended as part of the present disclosure.

Therefore, in view of the foregoing I claim:

1. An earring of unitary construction having a rotatable element, said earring comprising:

(a) a first ornamental portion having rotation means fixedly attached to said first ornamental portion, said rotation means comprising ball bearing rotation means including a central annular bearing retainer having a central opening formed therein, an outer annular bearing retainer, and a plurality of ball bearings disposed between said central bearing retainer and said outer bearing retainer, said outer bearing retainer being fixedly attached to said first ornamental portion, said rotation means axle extending through the central opening of said central bearing retainer, said first ornamental portion including a bearing seat and said outer bearing retainer being formed having an annular shoulder, said annular shoulder being disposed in said bearing seat, said outer bearing retainer being fixedly attached to said bearing seat by cutting and bending displaced portions of said bearing seat over said outer bearing retainer.

2. An earring of unitary construction having a rotatable element, said earring comprising:

(a) a first ornamental portion having rotation means fixedly attached to said first ornamental portion, said rotation means comprising ball bearing rotation means including a central annular bearing retainer having a central opening formed therein, an outer annular bearing retainer, and a plurality of ball bearings disposed between said central bearing retainer and said outer bearing retainer, said outer bearing retainer being fixedly attached to said first ornamental portion, said rotation means axle extending through the central opening of said central bearing retainer, said first ornamental portion including a bearing seat and said outer bearing retainer being formed having an annular shoulder, said annular shoulder being disposed in said bearing seat, said bearing seat including a plurality of bearing seat flanges, said outer bearing retainer being fixedly attached to said bearing seat by engagement of said flanges with said outer bearing retainer.

3. An earring of unitary construction having a rotatable element, said earring comprising:

a first ornamental portion having a bearing seat and ball bearing rotation means fixedly attached to said bearing seat, said ball bearing rotation means including a central annular bearing retainer having a central opening formed therein, an outer annular bearing retainer, and a plurality of ball bearings disposed between said central bearing retainer and said outer bearing retainer, said outer bearing retainer being fixedly attached to said bearing seat for fixed attachment of said ball bearing rotation means to said bearing seat;

a bearing cap assembly including a bearing cap, a bearing cap boss, a bearing axle and ear clasping means, said bearing cap having a recessed forward wall and a flat rearward wall, said bearing cap being formed with sufficient diameter to cover the ball bearing rotation means of said first ornamental portion and being disposed with the forward wall thereof to a rearward portion of the first ornamental portion, said bearing cap boss being disposed on the recessed forward wall of said bearing cap, a forward end of said boss engaging a rearward portion of the central bearing retainer of said ball bearing rotation means, said bearing axle extending forwardly from said bearing cap boss through the central opening of said ball bearing rotation means to a second ornamental portion, said ear clasping means being fixedly attached to the flat rearward wall of said bearing cap; and said second ornamental portion having a main body portion and a raised bearing surface extending from a rearward portion of said main body portion, said bearing surface engaging a forward portion of the central bearing retainer of said ball bearing rotation means, said main body portion being fixedly attached to a forward end of the bearing axle of said bearing cap assembly.

4. An earring as in claim 3 wherein said ear clasping means comprises an earlobe post fixedly attached to the rearward wall of said bearing cap and an earlobe clasp selectively receivable on said earlobe post.

5. An earring as in claim 3 wherein said ear clasping means comprises a first clamp arm and a second clamp arm pivotally attached about a pivot spring, said first clamp arm being fixedly attached to the rearward wall of said bearing cap.

6. A method of making the earring described in claim 3 comprising the steps of:

(a) die casting said first ornamental portion;

(b) fixedly attaching said ball bearing rotation means to the bearing seat of said first ornamental portion;

(c) die casting said second ornamental portion having an opening formed therein extending through said raised bearing surface and said main body portion;

(d) die casting said bearing cap, said bearing cap boss and said bearing axle as a single unitary construction, said bearing axle being of sufficient length to extend through said first ornamental portion and said second ornamental portion;

(e) fixedly attaching said ear clasping means to the rearward wall of said bearing cap;

(f) inserting said bearing axle through the central opening of the central bearing retainer of said ball bearing rotation means in said first ornamental portion from rear to front, and through the opening formed in said second ornamental portion from rear to front;

(g) pressing said second ornamental portion and said bearing cap tightly against said first ornamental portion;

(h) soldering the extending end of said bearing axle to the forward wall of the main body portion of said second ornamental portion while holding the second ornamental portion and the bearing cap tightly pressed against said first ornamental portion;

(i) cutting away any portion of said bearing axle extending beyond the forward wall of said second ornamental portion; and (j) polishing the forward wall of said second ornamental portion to a smooth finish.

7. A method of making the earring as described in claim 6 wherein the step of fixedly attaching said ball bearing rotation means to the bearing seat comprises gluing the outer bearing retainer to the bearing seat.

8. A method of making the earring as described in claim 6 wherein the step of fixedly attaching said ball bearing rotation means to the bearing seat comprises cutting and bending a portion of the bearing seat over the outer bearing retainer of said ball bearing rotation means.

9. A method of making the earring as described in claim 6 wherein the step of fixedly attaching said ball bearing rotation means to the bearing seat comprises bending bearing seat flanges over the outer bearing retainer of said ball bearing rotation means.

10. A method of making the earring described in claim 3 comprising the steps of:

(a) die casting said first ornamental portion;

(b) fixedly attaching said ball bearing rotation means to the bearing seat of said first ornamental portion;

(c) die casting said second ornamental portion having an opening formed therein extending through said raised bearing surface and said main body portion;

(d) die casting said bearing cap and said bearing cap boss as a single unitary construction;

(e) fixedly attaching said bearing axle to said bearing cap boss, said bearing axle being of sufficient length to extend through said first ornamental portion and said second ornamental portion;

f) fixedly attaching said ear clasping means to the rearward wall of said bearing cap;

(g) inserting said bearing axle through the central opening of the central bearing retainer of said ball bearing rotation means in said first ornamental portion from rear to front, and through the opening formed in said second ornamental portion from rear to front;

(h) pressing said second ornamental portion and said bearing cap tightly against said first ornamental portion;

(i) soldering the extending end of said bearing axle to the forward wall of the main body portion of said second ornamental portion while holding the second ornamental portion and the bearing cap tightly pressed against said first ornamental portion;

(j) cutting away any portion of said bearing axle extending beyond the forward wall of said second ornamental portion; and (k) polishing the forward wall of said second ornamental portion to a smooth finish.

11. A method of making a metal earring of unitary construction having a laterally rotatable element comprising the steps of:

(a) die casting a first ornamental portion;

(b) fixedly attaching rotation means to said first ornamental portion;

(c) die casting a second ornamental portion having an opening formed therein;

(d) die casting as an integral member a bearing cap of sufficient diameter to cover said rotation means and a bearing axle of sufficient length to extend through said first ornamental portion and said second ornamental portion;

(e) fixedly attaching ear clasping means to said bearing cap;

(f) inserting said bearing axle through said rotation means in the first ornamental portion and through said opening in the second ornamental portion;

(g) pressing said second ornamental portion and said bearing cap tightly against said first ornamental portion; and, (h) fixedly attaching said bearing axle to said second ornamental portion while holding the second ornamental portion and the bearing cap tightly pressed against said first ornamental portion.

* * * * *